US011920821B1

(12) United States Patent
Gibbon

(10) Patent No.: US 11,920,821 B1
(45) Date of Patent: Mar. 5, 2024

(54) ENERGY RECOVERY VENTILATOR

(71) Applicant: Nu-Air Ventilation Systems Incorporated, Windsor (CA)

(72) Inventor: Brian Keith Gibbon, Falmouth (CA)

(73) Assignee: Nu-Air Ventilation Systems Incorporated (CA)

( * ) Notice: Subject to any disclaimer, the term of this patent is extended or adjusted under 35 U.S.C. 154(b) by 0 days.

(21) Appl. No.: 18/228,221

(22) Filed: Jul. 31, 2023

(51) Int. Cl.

| | |
|---|---|
| ***F24F 12/00*** | (2006.01) |
| ***F24F 7/007*** | (2006.01) |
| ***F24F 11/41*** | (2018.01) |
| ***F24F 110/12*** | (2018.01) |

(52) U.S. Cl.
CPC ..... *F24F 12/006* (2013.01); *F24F 7/007* (2013.01); *F24F 11/41* (2018.01); *F24F 2110/12* (2018.01)

(58) Field of Classification Search
CPC ..... F24F 12/006; F24F 7/007; F24F 11/41; F24F 2110/12
USPC ..... 454/161
See application file for complete search history.

(56) References Cited

U.S. PATENT DOCUMENTS

| | | | | |
|---|---|---|---|---|
| 4,653,574 | A | 3/1987 | Quinlisk et al. | |
| 5,257,736 | A | 11/1993 | Roy | |
| 5,855,320 | A | 1/1999 | Grinbergs | |
| 6,169,849 | B1 | 1/2001 | Schmidt | |
| 6,176,305 | B1 * | 1/2001 | Haglid | F28D 9/0081 165/250 |
| 2017/0064920 | A1 * | 3/2017 | Xu | F28F 9/187 |
| 2019/0056134 | A1 * | 2/2019 | Hamada | F24F 11/41 |
| 2019/0128556 | A1 * | 5/2019 | Grinbergs | F24F 12/006 |
| 2021/0148597 | A1 * | 5/2021 | Hirsch | B60H 1/00514 |

* cited by examiner

*Primary Examiner* — Steven B McAllister
*Assistant Examiner* — Charles R Brawner
(74) *Attorney, Agent, or Firm* — Teitelbaum & Bouevitch; Neil Teitelbaum

(57) ABSTRACT

A dual configuration ERV can be connected directly to an east facing wall or west facing wall without requiring unnecessary conduit to accommodate the different configurations. Ports 1 and 2 are interchangeable so that Port 1 can be configured as a outside air port or a return air port, and port 2 can be configured oppositely and similarly. Each of these ports has associated therewith a temperature sensor and a fan. A controller interrupts a fan when the temperature is below a predetermined value so thereby preventing or lessening frost buildup on the heat exchanger core.

4 Claims, 4 Drawing Sheets

ENERGY RECOVERY VENTILATOR

FIELD

This disclosure relates to a energy recovery ventilator (ERV) and more particularly an ERV that is configurable in multiple configurations depending upon its connectivity.

BACKGROUND

An energy recovery ventilator (ERV) is a type of mechanical ventilation system that helps to improve indoor air quality while reducing energy consumption. It achieves this by exchanging heat or heat and moisture between the outgoing stale air and the incoming fresh air.

The primary function of an ERV is to provide fresh air to a building while simultaneously removing stale air. However, unlike a regular ventilation system that simply expels stale air and draws in fresh air, an ERV uses a heat exchanger to transfer heat and humidity from the outgoing air to the incoming air. This process helps to precondition the incoming air, making it closer in temperature and humidity to the indoor environment.

The heat exchanger in an ERV typically consists of two separate air streams that flow parallel to each other but never mix. This configuration allows the transfer of heat and moisture from the outgoing air to the incoming air without cross-contamination.

By recovering energy from the exhaust air, an ERV helps to reduce the energy required to heat or cool the incoming fresh air. During the heating season, the heat exchanger transfers warmth from the outgoing air to the incoming air, reducing the need for additional heating. In the cooling season, the process can be reversed, where the heat exchanger removes heat and humidity from the incoming air, reducing the load on the air conditioning system.

The use of an ERV can result in several benefits, including improved indoor air quality by providing a constant supply of fresh air, reduced energy consumption and associated costs, and better humidity control. It is commonly used in residential, commercial, and institutional buildings where a balance between ventilation and energy efficiency is desired.

It's worth noting that an ERV is similar to a heat recovery ventilator (HRV), but ERVs also transfer humidity in addition to heat. HRVs only transfer heat and not moisture. The choice between an ERV and HRV depends on the specific climate and ventilation needs of the building.

Conventional HRV devices, such as those disclosed in U.S. Pat. No. 4,653,574 issued Mar. 31, 1987 to L.B. White Company, Inc; U.S. Pat. No. 5,257,736 issued Nov. 2, 1993 to Donald Roy; U.S. Pat. No. 5,855,320 issued Jan. 5, 1999 in the name of Nutech Energy Systems Inc.; and U.S. Pat. No. 6,169,849 issued Jan. 2, 2001 to Olsberg Hermann Everken GmbH, provide a heat exchanging core to enable the transfer of heat from exhaust air to intake air. Unfortunately, prior art HRV systems do not, without drawbacks, solve the problem of heat exchange cores becoming too cold and frosting over.

A simple but effective frost prevention strategy may use a conventional defrosting system which shuts down the fresh air input fan and exhaust interior air through the heat exchange core.

One problem installers and manufacturers have when fabricating or installing ERVs is that differently configured units are required depending on the installation that is to be done. For instance, 4 port ERVs are typically made to be fit on a one side of a building and not easily fit on an opposite side. Therefore, installers and manufacturers have been forced to manufacture, stock and sell different units depending on which side of a building they will be installed on.

An object of the present invention is to overcome the shortcomings of the prior art by providing an HRV or ERV that can more effectively be used different configurations. For the purposes of this disclosure the term ERV used hereafter shall mean a device that can transfer heat or heat and moisture.

SUMMARY

In accordance with the disclosure there is provided an energy recovery ventilator (ERV) comprising, a housing having:

a) a first pair of ports P1 and P2 coupled thereto, wherein P1 is coupled to the housing a distance away from P2, wherein P1 and P2 are functionally interchangeable such that P1 can be configured as an outside-air port or a return-air port, and P2 can be configured as a return-air port or an outside-air port wherein P1 and P2 in operation are configured differently from each other such that when P1 is configured as an outside-air port, P2 is configured as a return-air port and vice versa;

b) a second pair of ports P3 and P4, coupled to the housing wherein P3 is a distance away from P4, wherein P3 and P4 are functionally interchangeable such that P3 can be configured as an exhaust-air port or a supply-air port, and P4 can be configured as a supply-air port or an exhaust-air port wherein P3 and P4 in operation are configured differently from each other such that when P3 is configured as an exhaust-air port, P4 is configured as a supply-air port, or vice versa, wherein air can pass between P1 and P4 and wherein air can pass between P2 and P3;

c) a first temperature sensor associated with P1 for sensing a temperature about P1 and d) a second temperature sensor associated with P2 for sensing a temperature about P2, wherein in operation at least one of said temperature sensors is coupled to a controller, said controller for controlling the operation of at least one fan in dependence upon information received from at least one of the temperature sensors; and, e) a heat exchanger supported by the housing coupled to the first pair of ports and the second pair of ports for transferring energy from one airstream to another.

In accordance with the disclosure there is further provided an ERV comprising a housing having:

a first damperless port disposed on a first side thereof and having a second damperless port on a second opposite side of the housing, the first damperless port having a fan F1 for supplying air or exhausting air, the second damperless port having a fan F2, for exhausting air or supplying air to its associated port;

a third damperless port disposed on the second side of the housing in air communication with the first damperless port, a fourth damperless port disposed on the first side of the housing in air communication with the second damperless port;

a temperature sensor T1 housed about the first damperless port;

a temperature sensor T2 housed about the second damperless port; and, a controller for temporarily interrupting the operation of at least one of the fans in dependence upon information received from at least one of the temperature sensors;

wherein the housing is capable of being installed with the first side or the second side thereof adjacent an outside wall such that the first damperless port or the second damperless port can supply outside air to the housing.

DETAILED DESCRIPTION

Figure 1:
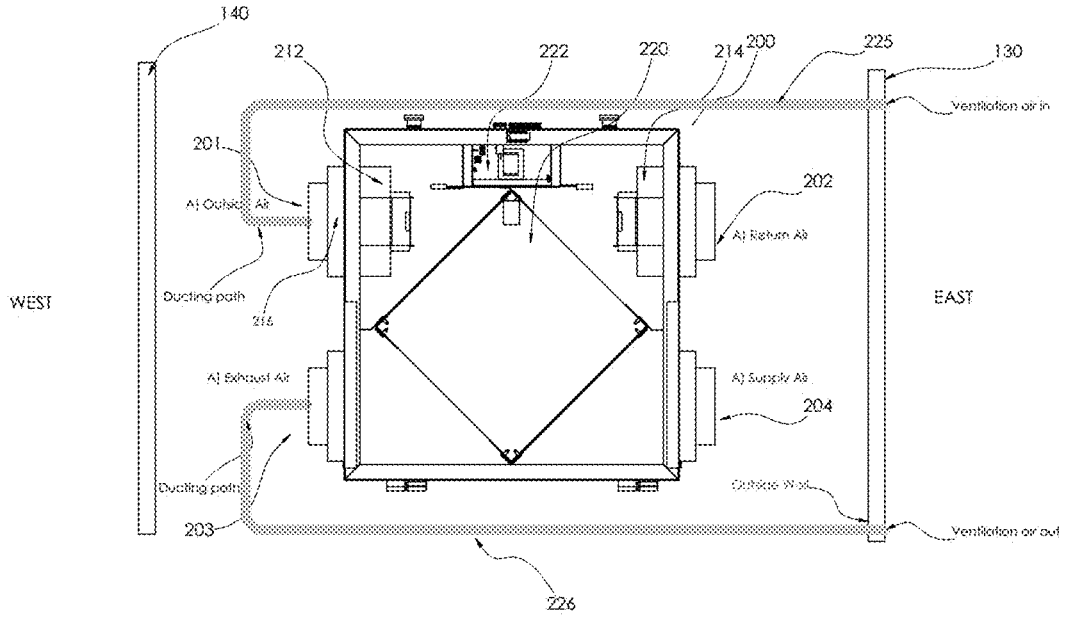
FIG. 1 is a schematic diagram illustrating a prior art ERV shown installed wherein substantial lengths of venting are required so that the ERV can be facing in preferred direction for servicing.

Referring now to FIG. 1 a prior art ERV is shown wherein the outside air port 201 and exhaust air port 203 are facing away from the outside wall 230 to which they are coupled through ventilation conduits 225 and 226 respectively. An outside air fan 212 sucks air through conduit 225 and a return air fan 214 moves return air to the exhaust air port 203 coupled to conduit 226 which ports out ventilation air. A single temperature sensor 216 resides inside of outside air port 201 which senses the incoming outside air temperature and controls the fan 212 accordingly to prevent the heat exchanger core 220 from frost build-up. The ERV shown in FIG. 1 is only capable of being connected in one direction; thus there is only one option in connecting the ventilation outside air in, to a single port; that is, to port 201. Because of this directional limitation, an installer with only the device shown in FIG. 1, must use two lengths of conduit to install the device to the wall shown. Clearly the ERV shown in FIG. 1 is more suited to be installed on the wall ports 201 and 203 face not requiring conduits 225 and 226 rather than the opposite wall they are coupled to. Alternatively an installer would have on hand an East and a West facing ERV in order to suit both situations. This would obviate the need to use conduit lengths 225 and 226. Both solutions are costly and less than ideal.

Figure 2:
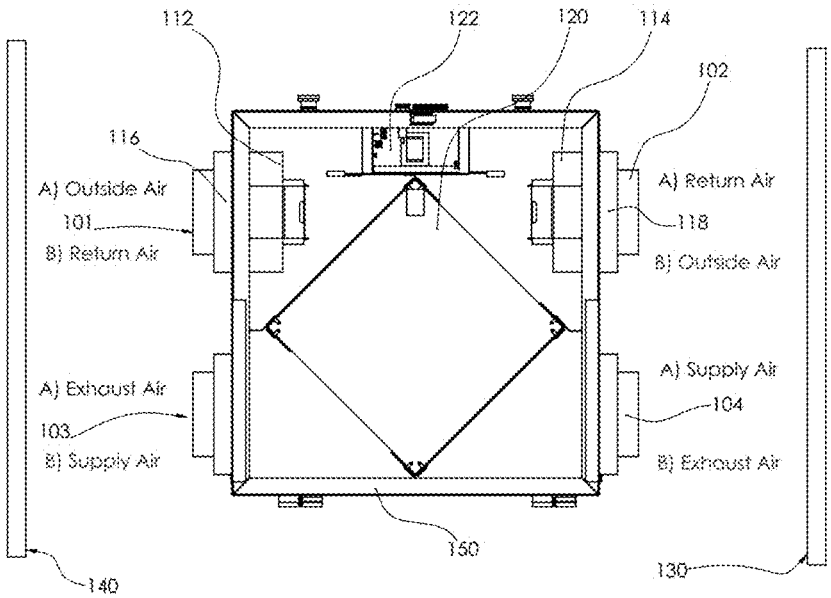
FIG. 2 is a schematic diagram illustrating an ERV as is described and claimed in this specification.
Figure 3:
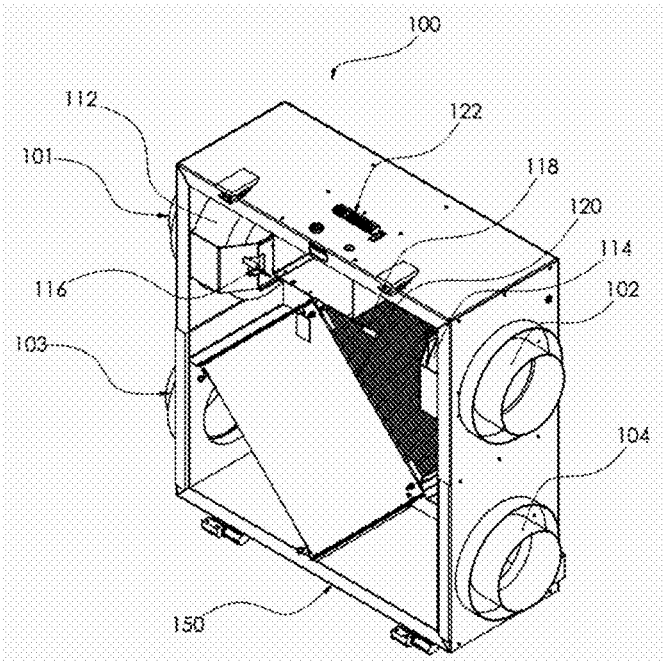
FIG. 3 is a perspective view of ERV shown in FIG. 2.

Turning now to FIG. 2, an ERV is shown which obviates the need for the lengths of conduit 225 and 226 shown in FIG. 1 and obviates the need for an installer to bring to each job, 2 ERVs, an East facing ERV and a West Facing ERV of FIG. 1. The housing 150 of ERV 100 is shown having a conventional core heat exchanger 120 formed of cross-flow plates however could be another type such as wheel heat exchanger. In operation, the first and second ports 101 and 102 respectively can function as outside air ports or return air ports depending on whether the unit is installed on an east or west facing wall. This ability to configure the ERV 100 to adapt to either the east or west facing wall obviates the requirement for the conduit shown in FIG. 1. The terms east facing and west facing are used to indicate opposite facing walls. Of course, the terms north or south facing could be substituted.

When the system is configured so that port 101 is an outside air port, port 102 serves as a return air port, or, vice-versa. This ability for an installer to configure the unit this way offers a convenience and cost savings not found in the ERV of FIG. 1. Port 103 can be configured as a supply air port or an exhaust air port and port 104 can be configured as a supply air port or exhaust air port. Of course when port 103 serves as an exhaust air port 104 would serve as a supply air port, or, vice-versa. Thus in a first configuration port 101 is connected directly to an outside wall and brings in outside air which is directed through the heat exchanger 120 to port 4 which is configured as an exhaust air port. Port 2 is a return air port bringing return air into the heat exchanger and expelling this air into port 3 which serves as an exhaust air port. Alternatively, if the ERV is connected to an oppositely facing wall, port 102 is connected directly to an outside wall and brings in outside air which is directed through the heat exchanger 120 to port 3 which is configured as an exhaust air port. Port 1 is a return air port bringing return air into the heat exchanger and expelling this air into port 4 which serves as an exhaust air port. In a preferred embodiment the system functions as a damperless ERV. The term damperless means that the ERV does not have any automatically controlled dampers or electronically actuatable dampers which is an additional cost savings and obviates additional non-required moving parts. Only 2 fans 112 and 114 are required as are two temperature sensors 116 and 118. Having two temperature sensors, one at port 1 and one at port 2 allows an installer to use a same ERV to be installed in either the first or second configuration. Ports 3 and 4 are fanless ports, neither port having a fan. When port 1 is installed at an outside wall 140, temperature sensor 116 measures the outside air temperature and provides temperature data to the controller 122 which shuts down the fan 112 associated with port 1 when the temperature is at or below a predetermined value to prevent frost buildup on the heat exchanger core 120. Alternatively, when port 2 is installed against an outside wall 130 temperature sensor 118 measures the outside air temperature and provides temperature data to the controller 122 which shuts down the fan 114 associated with port 1 when the temperature is at or below a predetermined value to prevent frost buildup on the heat exchanger core 120.

Figure 4:
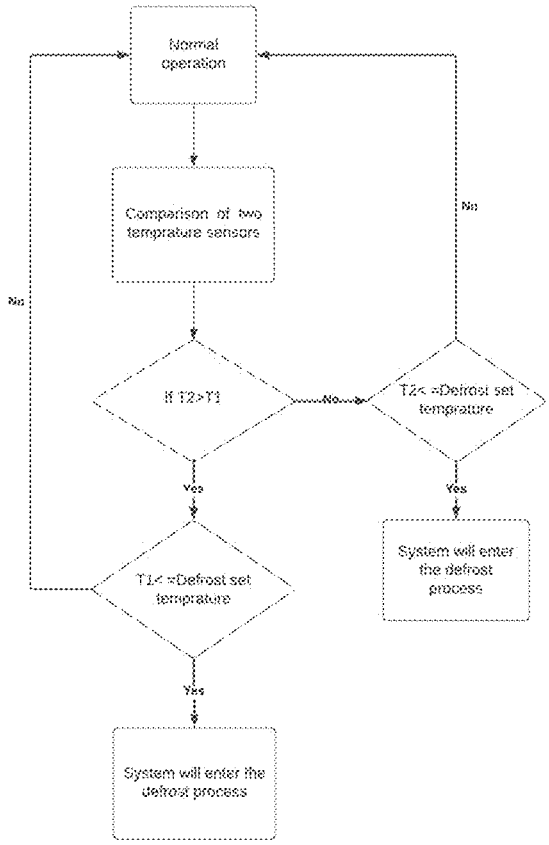
FIG. 4 is a flow chart of the algorithm executed by a processor within the controller.

FIG. 4 is a flow chart showing an the system in operation where data from the temperature sensor at port 1 is compared with data from the temperature sensor at port 2. When the condition is satisfied that either T1 or T2 is less or equal to the defrost temperature the fan associated with the low temperature is suspended.

Figure 5A:
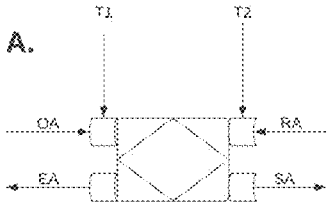
FIGS. 5*a* and 5*b* illustrate two different configurations.
Figure 5B:
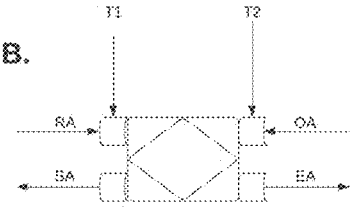

FIGS. 5A and 5B illustrate the two different configurations in which the ERV can be installed. In FIG. 5A T1 is the sensor that provides outside air temperature to the controller and in FIG. 5B, T2 provides outside air temperature to the controller.

What is claimed is:

1. An ERV comprising a housing having:

a first damperless port disposed on a first side thereof and having a second damperless port on a second opposite side of the housing, the first damperless port having a fan F1 for supplying air or exhausting air, the second damperless port having a fan F2, for exhausting air or supplying air to its associated port;

a third damperless port disposed on the second side of the housing in air communication with the first damperless port, wherein the third damperless port is a fanless port;

a fourth damperless port disposed on the first side of the housing in air communication with the second damperless port, wherein the fourth damperless port is a fanless port;

a heat or heat and moisture exchanger disposed between the first damperless port and the third damperless port, and between the second damperless port and the fourth damperless port;

a temperature sensor T1 housed about the first damperless port;

a temperature sensor T2 housed about the second damperless port; and, a controller for temporarily interrupting the operation of at least one of the fans in dependence upon information received from at least one of the temperature sensors, wherein the controller includes a suitably programmed processor, wherein the suitably programmed processor in operation is responsive to received sensor information in the form of values from temperature sensor T1 and temperature sensor T2 and wherein the values are compared and wherein the processor provides a signal to cease operation of one of the two fans in dependence upon the comparison if the lower value is less than or equal to a predetermined value, wherein the fan whose operation is ceased is a fan closest to an outside wall and the other of the two fans is further from the outside wall upon which the ERV is installed; and, wherein the housing is capable of being installed with the first side or the second side thereof adjacent an outside wall such that the first damperless port or the second damperless port can supply outside air to the housing.

2. An ERV as defined in claim 1, wherein the predetermined value is selected to lessen frost buildup within a core of the heat or heat and moisture exchanger.

3. An ERV comprising a housing having:

a first damperless port disposed on a first side thereof and having a second damperless port on a second opposite side of the housing, the first damperless port having a fan F1 for supplying air or exhausting air, the second damperless port having a fan F2, for exhausting air or supplying air to its associated port;

a third damperless port disposed on the second side of the housing in air communication with the first damperless port, wherein the third damperless port is a fanless port;

a fourth damperless port disposed on the first side of the housing in air communication with the second damperless port, wherein the fourth damperless port is a fanless port;

a heat or heat and moisture exchanger disposed between the first damperless port and the third damperless port, and between the second damperless port and the fourth damperless port;

a temperature sensor T1 housed about the first damperless port;

a temperature sensor T2 housed about the second damperless port; and, a controller for temporarily interrupting the operation of at least one of the fans in dependence upon information received from at least one of the temperature sensors, wherein the controller includes a suitably programmed processor, wherein the suitably programmed processor in operation is responsive to received sensor information in the form of values from temperature sensor T1 and temperature sensor T2 and wherein the values are compared and wherein the processor provides a signal to cease operation of one of the two fans in dependence upon the comparison if the lower value is less than or equal to a predetermined value, wherein the fan whose operation is ceased most directly ducts to the outside wall and the other of the two fans most directly ducts to an opposite side; and, wherein the housing is capable of being installed with the first side or the second side thereof adjacent an outside wall such that the first damperless port or the second damperless port can supply outside air to the housing.

4. An ERV as defined in claim 3, wherein the predetermined value is selected to lessen frost buildup within a core of the heat or heat and moisture exchanger.

* * * * *